US006134765A

United States Patent [19]

Ward

[11] Patent Number: 6,134,765

[45] Date of Patent: Oct. 24, 2000

[54] CAMSHAFT REMOVAL TOOL

[76] Inventor: Steven Wiley Ward, 3918 Bethel Rd., Sugar Grove, N.C. 28679

[21] Appl. No.: 09/473,090

[22] Filed: Dec. 28, 1999

[51] Int. Cl.[7] ..... B25B 27/14

[52] U.S. Cl. ..... 29/278

[58] Field of Search ..... 29/278, 280, 270, 29/281.1, 263, 264, 254, 255

[56] References Cited

U.S. PATENT DOCUMENTS

| | | | |
|---|---|---|---|
| 3,106,012 | 10/1963 | Comer | 29/254 |
| 3,200,484 | 8/1965 | Garman | 29/263 |
| 4,207,663 | 6/1980 | Page | 29/263 |
| 4,338,711 | 7/1982 | Wright | 29/263 |
| 4,675,968 | 6/1987 | Barlett | 29/254 |

*Primary Examiner*—Robert C. Watson

[57] ABSTRACT

A camshaft removal tool for connecting to a camshaft so that camshaft may be removed or inserted without damaging engine components. The camshaft removal tool includes a tubular member. The tubular member has a first end and a second end. The tubular member is hollow. A wall for connection to the camshaft is fixedly coupled to the second end of the tubular member. A plurality of mounting bores is located in the wall. A plurality of access slots in the peripheral wall offers access to the bores. Each of the access slots is oriented at the second end of the tubular member and extends toward the first end of the tubular member.

6 Claims, 2 Drawing Sheets

CAMSHAFT REMOVAL TOOL

BACKGROUND OF THE INVENTION

1. Field of the Invention

The present invention relates to tools and more particularly pertains to a new camshaft removal tool for connecting to a camshaft so that camshaft may be removed or inserted without damaging engine components.

2. Description of the Prior Art

The use of tools is known in the prior art. More specifically, tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,794,683; U.S. Pat. No. 4,996,768; U.S. Pat. No. 4,450,609; U.S. Pat. No. 3,979,811; U.S. Pat. Des. No. 364,023; and U.S. Pat. Des. No. 377,745.

While these devices fulfill their respective, particular objectives and requirements, the aforementioned patents do not disclose a new camshaft removal tool. The inventive device includes a tubular member. The tubular member has a first end and a second end. The tubular member is hollow. A wall for connection to the camshaft is fixedly coupled to the second end of the tubular member. A plurality of mounting bores is located in the wall. A plurality of access slots in the peripheral wall offers access to the bores. Each of the access slots is oriented at the second end of the tubular member and extends toward the first end of the tubular member.

In these respects, the camshaft removal tool according to the present invention substantially departs from the conventional concepts and designs of the prior art, and in so doing provides an apparatus primarily developed for the purpose of connecting to a camshaft so that camshaft may be removed or inserted without damaging engine components.

SUMMARY OF THE INVENTION

In view of the foregoing disadvantages inherent in the known types of tools now present in the prior art, the present invention provides a new camshaft removal tool construction wherein the same can be utilized for connecting to a camshaft so that camshaft may be removed or inserted without damaging engine components.

The general purpose of the present invention, which will be described subsequently in greater detail, is to provide a new camshaft removal tool apparatus and method which has many of the advantages of the tools mentioned heretofore and many novel features that result in a new camshaft removal tool which is not anticipated, rendered obvious, suggested, or even implied by any of the prior art tools, either alone or in any combination thereof.

To attain this, the present invention generally comprises a tubular member. The tubular member has a first end and a second end. The tubular member is hollow. A wall for connection to the camshaft is fixedly coupled to the second end of the tubular member. A plurality of mounting bores is located in the wall. A plurality of access slots in the peripheral wall offers access to the bores. Each of the access slots is oriented at the second end of the tubular member and extends toward the first end of the tubular member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new camshaft removal tool apparatus and method which has many of the advantages of the tools mentioned heretofore and many novel features that result in a new camshaft removal tool which is not anticipated, rendered obvious, suggested, or even implied by any of the prior art tools, either alone or in any combination thereof.

It is another object of the present invention to provide a new camshaft removal tool which may be easily and efficiently manufactured and marketed.

It is a further object of the present invention to provide a new camshaft removal tool which is of a durable and reliable construction.

An even further object of the present invention is to provide a new camshaft removal tool which is susceptible of a low cost of manufacture with regard to both materials and labor, and which accordingly is then susceptible of low prices of sale to the consuming public, thereby making such camshaft removal tool economically available to the buying public.

Still yet another object of the present invention is to provide a new camshaft removal tool which provides in the apparatuses and methods of the prior art some of the advantages thereof, while simultaneously overcoming some of the disadvantages normally associated therewith.

Still another object of the present invention is to provide a new camshaft removal tool for connecting to a camshaft so that camshaft may be removed or inserted without damaging engine components.

Yet another object of the present invention is to provide a new camshaft removal tool which includes a tubular member. The tubular member has a first end and a second end.

The tubular member is hollow. A wall for connection to the camshaft is fixedly coupled to the second end of the tubular member. A plurality of mounting bores is located in the wall. A plurality of access slots in the peripheral wall offers access to the bores. Each of the access slots is oriented at the second end of the tubular member and extends toward the first end of the tubular member.

Still yet another object of the present invention is to provide a new camshaft removal tool that can be used to safely remove a camshaft.

Even still another object of the present invention is to provide a new camshaft removal tool that is easier to grip and has easier access than previous tools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
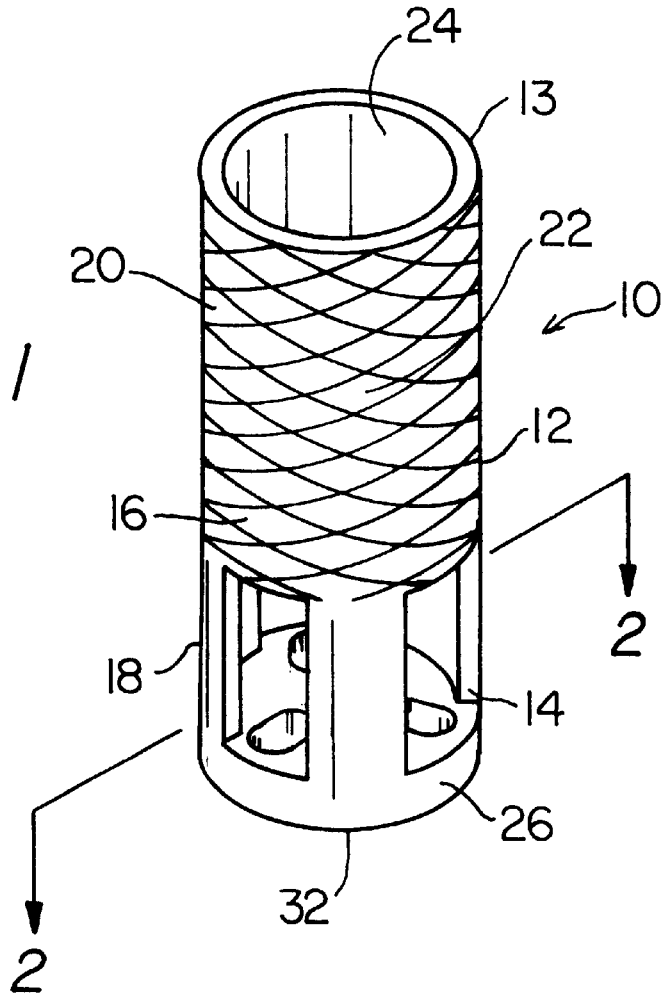
FIG. 1 is a schematic perspective view of a new camshaft removal tool according to the present invention.
Figure 2:
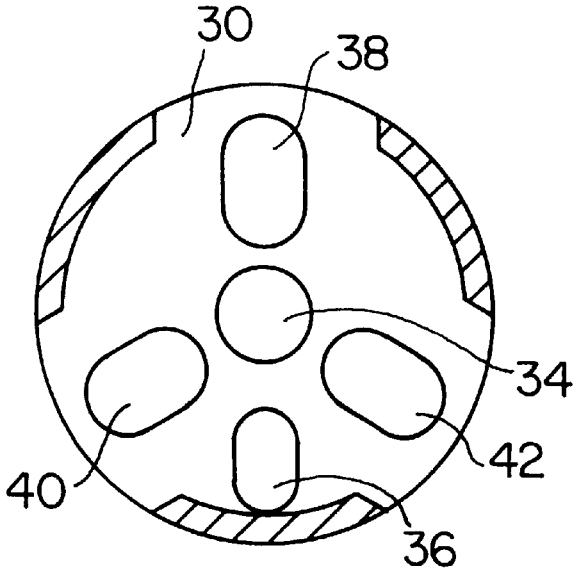
FIG. 2 is a schematic cross-sectional plan view taken along line 2—2 of the present invention.
Figure 3:
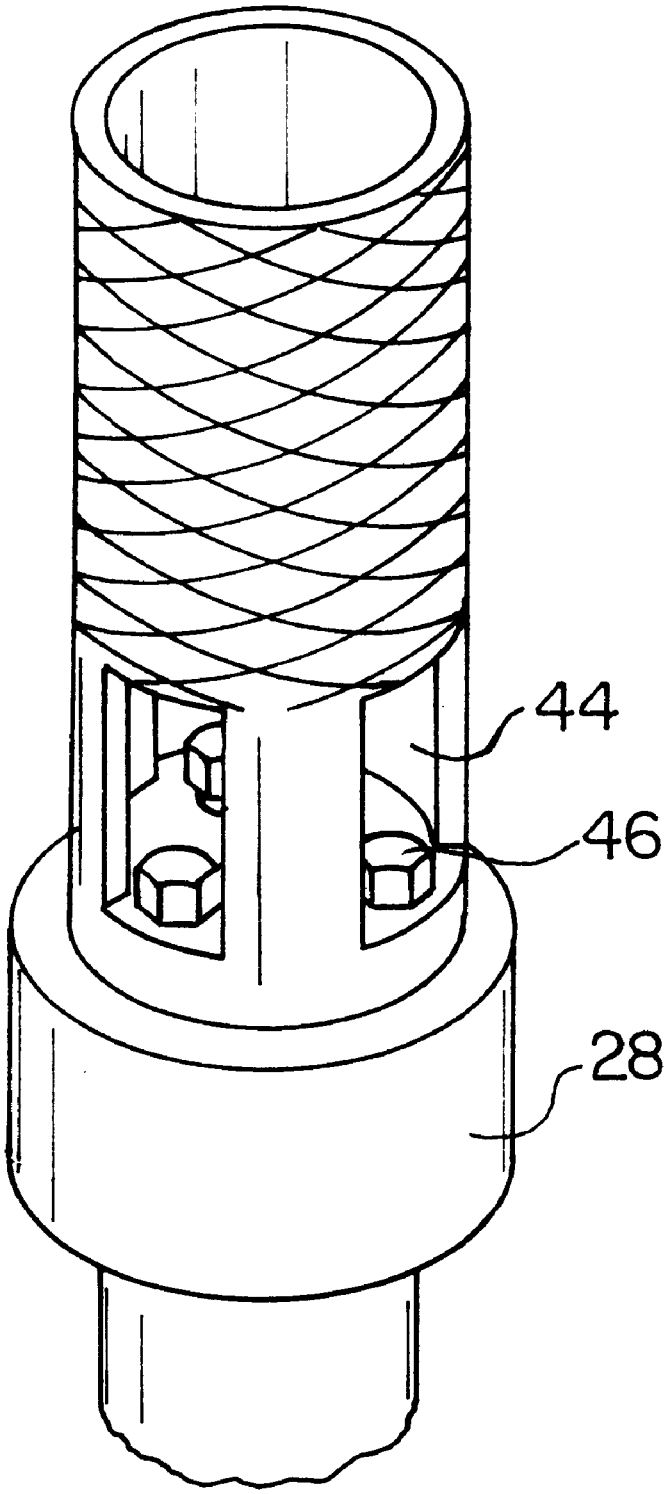
FIG. 3 is a schematic perspective view of the present invention.

With reference now to the drawings, and in particular to FIGS. 1 through 3 thereof, a new camshaft removal tool embodying the principles and concepts of the present invention and generally designated by the reference numeral 10 will be described.

As best illustrated in FIGS. 1 through 3, the camshaft removal tool 10 generally comprises a tubular member 12. The tubular member has a first end 13, a second end 14, and a peripheral wall 16 between the first 13 and second ends 14. The tubular member 12 has a generally circular cross-section traverse to the longitudinal axis of the tubular member 12. The tubular member has a distal portion 18 and a proximal portion 20. The proximal portion 20 is located generally adjacent to the first end 13 of the tubular member 12. The distal portion 18 is located generally adjacent to the second end 14 of the tubular member 12. The tubular member 12 is hollow and the first end 13 of the tubular member 12 is open. The peripheral wall 16 has an exterior surface 22 and an interior surface 24. The proximal portion 20 of the exterior 22 surface of the peripheral wall 16 is roughened to enhance grip on the proximal portion. Ideally, the exterior surface of is knurled.

A wall 26 connects tubular member 12 to the camshaft 28. The wall 26 is fixedly coupled to the second end 14 of the tubular member 12. The wall 26 has an inside surface 30 and an exterior surface 32. The wall 26 is generally planar and has a generally circular shaped edge. The wall 26 has an axis passing through a central portion of the wall.

A first mounting bore 34 in the wall 26 generally extends along the axis of the wall 26.

A second mounting bore 36 in the wall 26 is generally located adjacent to the interior surface 24 of the peripheral wall 12. Preferably, the second bore 36 has a generally oblong shape. The oblong second bore 36 has a longitudinal axis generally bisecting the first bore 34 such that the longitudinal axis extends along a diameter of the circular wall 26.

A third mounting bore 38 in the wall 26 is located generally adjacent to the interior surface 24 of the peripheral wall 12. The third bore 38 is located on an opposite side of the first bore 34 in relation to the second bore 36. The third bore 38 preferably has a generally oblong shape. The third bore 38 preferably shares a longitudinal axis with the second bore 36 such that the longitudinal axis extends along a diameter of the circular wall 26.

A fourth 40 and a fifth 42 mounting bore in the wall 26 are each generally adjacent to the interior surface 24 of the peripheral wall 12. The fourth 40 and fifth 42 bores are each generally oblong shaped. Each of the fourth 40 and fifth 42 bores has a longitudinal axis. Each of the longitudinal axes of the fourth 40 and fifth 42 bores generally bisect the first bore 34. The longitudinal axes of the third 38, fourth 40 and fifth 42 bores are oriented at approximately one hundred twenty degrees to each other such that each of the longitudinal axes extends along a diameter of the circular wall 26.

Three access slots 44 in the peripheral wall offer access to the bores. Each of the access slots 44 is oriented at the second end 14 of the tubular member 12 and each extends toward the first end 13 of the tubular member 12. One of the slots 44 is adjacent to each of the third 38, fourth 40 and fifth bores 42. The slots 44 extend to a juncture of the distal 18 and proximal portions 20 of the tubular member 12. Preferably, each of the slots 44 is generally rectangular shaped.

In use, the bolts 46 holding the camshaft are removed. The wall 26 is placed against the camshaft 28 so that the bolts 46 can be inserted through the mounting bores and back into the camshaft 28 such that the wall 26 is secured to the camshaft 28. The camshaft 28 can then be moved by gripping the proximal portion 20 of the tubular member 12 without fear of damaging engine components.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A camshaft tool for removing and manipulating a camshaft within an engine, said tool comprising:

a tubular member, said tubular member having a first end and a second end, said tubular member being hollow;

a wall for connection to the camshaft, said wall being fixedly coupled to said second end of said tubular member;

a plurality of mounting bores in said wall; and a plurality of access slots in said peripheral wall for access to said bores, each of said access slots being oriented at said second end of said tubular member and extending toward said first end of said tubular member.

2. The camshaft tool for removing and manipulating a camshaft within an engine as in claim 1, wherein said tubular member comprises:

said tubular member having a peripheral wall between said first and second end, said tubular member having a generally circular cross-section traverse to the longitudinal axis of said tubular member, said tubular member having a distal portion and a proximal portion, said proximal portion being located generally adjacent to said first end of said tubular member, said distal portion being located generally adjacent to said second end of said tubular member, said first end of said tubular member being open, said peripheral wall having an exterior surface and an interior surface, said proximal portion of said exterior surface of said peripheral wall being roughened to enhance grip on said proximal portion.

3. The camshaft tool for removing and manipulating a camshaft within an engine as in claim 1, wherein said wall further comprises:

said wall having an inside surface and an exterior surface, said wall being generally planar, said wall having a generally circular shaped edge, said wall having an axis passing through a central portion of said wall.

4. The camshaft tool for removing and manipulating a camshaft within an engine as in claim 3, wherein said plurality of mounting bores is five mounting bores, said five bores comprising:

a first mounting bore in said wall, said first mounting bore being generally extending along said axis of said wall;

a second mounting bore in said wall, said second mounting bore being generally located adjacent to said interior surface of said peripheral wall, said second bore having a longitudinal axis being generally bisecting said first bore such that said longitudinal axis extends along a diameter of said circular wall;

a third mounting bore in said wall, said third mounting bore being located generally adjacent to said interior surface of said peripheral wall, said third bore being located on an opposite side of said first bore in relation to said second bore, said third bore having generally sharing a longitudinal axis with said second bore such that said longitudinal axis extends along a diameter of said circular wall; and a fourth and a fifth mounting bore in said wall, said fourth and fifth bores each being generally adjacent to said interior surface of said peripheral wall, each of said fourth and fifth bores having a longitudinal axis, each of said longitudinal axes of said fourth and fifth bores generally bisecting said first bore, each said longitudinal axis of said third, fourth and fifth bores being oriented at approximately one hundred twenty degrees to each other such that each of said longitudinal axes extends along a diameter of said circular wall.

5. The camshaft tool for removing and manipulating a camshaft within an engine as in claim 4, wherein said plurality of access slots comprise:

three access slots in said peripheral wall for access to said bores, each of said access slots being oriented at said second end of said tubular member and extending toward said first end of said tubular member, one of said slots being adjacent to each of said third, fourth and fifth bores, each of said slots extending to a juncture of said distal and proximal portions of said tubular member.

6. A camshaft tool for removing and manipulating a camshaft within an engine, said tool comprising:

a tubular member, said tubular member having a first end, a second end, and a peripheral wall between said first and second end, said tubular member having a generally circular cross-section traverse to the longitudinal axis of said tubular member, said tubular member having a distal portion and a proximal portion, said proximal portion being located generally adjacent to said first end of said tubular member, said distal portion being located generally adjacent to said second end of said tubular member, said tubular member being hollow, said first end of said tubular member being open, said peripheral wall having an exterior surface and an interior surface, said proximal portion of said exterior surface of said peripheral wall being roughened to enhance grip on said proximal portion, said exterior surface of being knurled;

a wall for connection to the camshaft, said wall being fixedly coupled to said second end of said tubular member, said wall having an inside surface and an exterior surface, said wall being generally planar, said wall having a generally circular shaped edge, said wall having an axis passing through a central portion of said wall;

a first mounting bore in said wall, said first mounting bore being generally extending along said axis of said wall;

a second mounting bore in said wall, said second mounting bore being generally located adjacent to said interior surface of said peripheral wall, said second bore having a generally oblong shape, said oblong second bore having a longitudinal axis being generally bisecting said first bore such that said longitudinal axis extends along a diameter of said circular wall;

a third mounting bore in said wall, said third mounting bore being located generally adjacent to said interior surface of said peripheral wall, said third bore being located on an opposite side of said first bore in relation to said second bore, said third bore having a generally oblong shape, said third bore having generally sharing a longitudinal axis with said second bore such that said longitudinal axis extends along a diameter of said circular wall;

a fourth and a fifth mounting bore in said wall, said fourth and fifth bores each being generally adjacent to said interior surface of said peripheral wall, said fourth and fifth bores each being generally oblong shaped, each of said fourth and fifth bores having a longitudinal axis, each of said longitudinal axes of said fourth and fifth bores generally bisecting said first bore, each said longitudinal axis of said third, fourth and fifth bores being oriented at approximately one hundred twenty degrees to each other such that each of said longitudinal axes extends along a diameter of said circular wall; and three access slots in said peripheral wall for access to said bores, each of said access slots being oriented at said second end of said tubular member and extending toward said first end of said tubular member, one of said slots being adjacent to each of said third, fourth and fifth bores, each of said slots extending to a juncture of said distal and proximal portions of said tubular member, each of said slots being generally rectangular shaped.

* * * * *